United States Patent [19]

Kobayashi

[11] Patent Number: 4,783,824

[45] Date of Patent: Nov. 8, 1988

[54] SPEAKER UNIT HAVING TWO VOICE COILS WOUND AROUND A COMMON COIL BOBBIN

[75] Inventor: Yoshihiro Kobayashi, Tokyo, Japan

[73] Assignee: Trio Kabushiki Kaisha, Japan

[21] Appl. No.: 789,028

[22] Filed: Oct. 18, 1985

[30] Foreign Application Priority Data

Oct. 23, 1984 [JP] Japan ..... 59-159147[U]

[51] Int. Cl.[4] ..... H04R 9/06; H04R 9/04; H04R 1/24

[52] U.S. Cl. ..... 381/195; 381/96; 381/192; 381/194; 381/199; 381/201

[58] Field of Search ..... 179/155.5 DV, 115.5 R, 179/115.5 VC, 117, 119 R, , 115.5 SF; 381/96, 192, 193, 194, 195, 199, 200, 201

[56] References Cited

U.S. PATENT DOCUMENTS

| | | | |
|---|---|---|---|
| 2,007,747 | 7/1935 | Ringel | 381/195 |
| 2,269,284 | 1/1942 | Olson | 381/156 |
| 2,727,949 | 12/1955 | Lokkesmoe | 381/194 |
| 3,196,211 | 7/1965 | Kessenich | 381/195 |
| 3,686,446 | 8/1972 | Manger | 381/195 |
| 3,798,374 | 3/1974 | Meyers | 381/96 |
| 4,220,832 | 9/1980 | Nagel | 381/195 |
| 4,243,839 | 1/1981 | Takahashi et al. | 381/96 |
| 4,438,297 | 3/1984 | Kawamura | 381/194 |
| 4,465,906 | 8/1984 | Adolph et al. | 381/194 |
| 4,492,827 | 1/1985 | Shintaku | 381/194 |
| 4,529,846 | 7/1985 | Freeman et al. | 381/196 |
| 4,586,192 | 4/1986 | Arntson | 381/195 |
| 4,609,784 | 9/1986 | Miller | 381/96 |

FOREIGN PATENT DOCUMENTS

| | | | |
|---|---|---|---|
| 968234 | 11/1950 | France | 381/195 |
| 55-37066 | 3/1980 | Japan | 381/195 |
| 59-192000 | 10/1984 | Japan | 381/195 |
| 670667 | 4/1952 | United Kingdom | 179/115.5 SF |
| 705100 | 3/1954 | United Kingdom | 179/115.5 DV |

*Primary Examiner*—Jin F. Ng
*Assistant Examiner*—Danita R. Byrd
*Attorney, Agent, or Firm*—Gerald J. Ferguson, Jr.

[57] ABSTRACT

A speaker unit having a pair of voice coils each wound around a common coil bobbin and a first magnet for driving one coil of the pair of voice coils. A second magnet is provided for suppressing flux leakage of the first magnet and driving one coil of the pair of voice coils.

9 Claims, 3 Drawing Sheets

SPEAKER UNIT HAVING TWO VOICE COILS WOUND AROUND A COMMON COIL BOBBIN

BACKGROUND OF THE INVENTION

1. Field of the Invention

The present invention relates to a speaker unit, and more particularly to a speaker unit compatible with an audio/visual device (hereinafter called an A/V device).

2. Description of the Prior Art

A conventional speaker unit compatible with an A/V device is provided with a magnetic shield cover for suppressing adverse magnetic influence of the speaker unit upon a television screen. Such speaker unit is, for example, disclosed in U.S. Pat. No. 4,465,908. An example of such a speaker unit is shown in FIG. 1. A magnetic circuit unit 1 is covered with a magnetic shield cover 2 made of iron sheet and formed generally in a tubular shape with a bottom, thereby shielding magnetic flux from the magnetic circuit unit 1. The magnetic shield cover 2 is mounted on a second magnet 5 upon which a yoke 3 and a first magnet 4 opposite in polarity to the second magnet 5 are mounted. In the figure, reference 6 represents a top plate, references 8, 9, 10 and 11 respectively represent a voice coil bobbin, diaphragm, damper and dust cap.

In the speaker unit described above, the second magnet 5 is disposed only for the purpose of magnetic shielding and does not serve as an element of the magnetic drive circuit, which makes the unit uneconomical.

Furthermore, a speaker in general has an impedance rise at about $f_0$ in its enclosure characteristic. It is known in the art that such characteristic causes a considerable deterioration in fidelity at a low frequency.

In order to improve this, a speaker system has been proposed which used two stack-wound voice coils, one coil being supplied with a usual signal current and the other coil with a control signal current. With this speaker system, however, there is a limit to the quantity of magnetic energy at the gap where the two voice coils are disposed. Also, a large gap is required because of an increase in coil thickness. Thus, it can be understood easily that a remarkable effect cannot be expected for such system.

SUMMARY OF THE INVENTION

It is an object of the present invention to solve the above prior art problems and, in order to drive the voice coil, positively use the magnetic flux of the conventional magnet which has been used only for magnetic shielding.

To achieve the above object, the speaker unit according to the present invention includes a voice coil and a first magnet for driving the voice coil.

DESCRIPTION OF THE PREFERRED EMBODIMENTS

The embodiment of the speaker unit of the present invention will now be described with reference to FIGS. 2 and 3.

Figure 1:
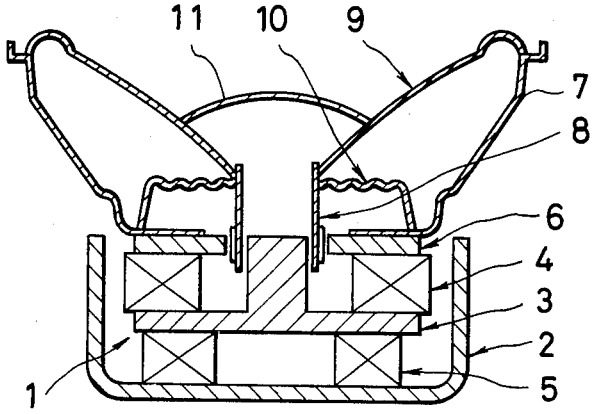
FIG.1 PRIOR ART
FIG. 1 is a cross sectional view of a conventional speaker unit compatible with an A/V device.
Figure 2:
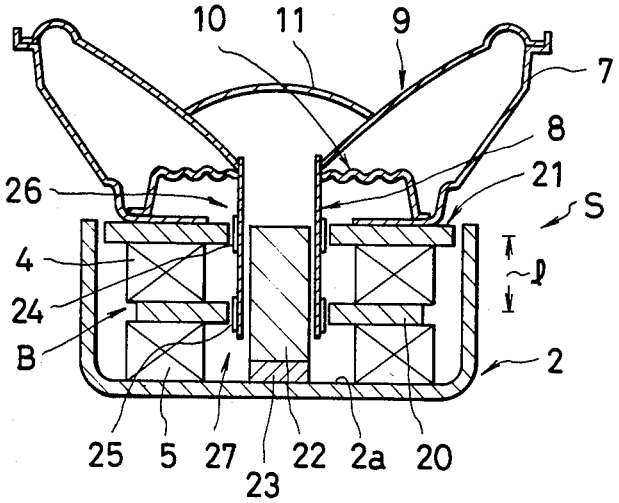
FIG. 2 is a cross sectional view showing an embodiment of the speaker unit according to the present invention.
Figure 3:
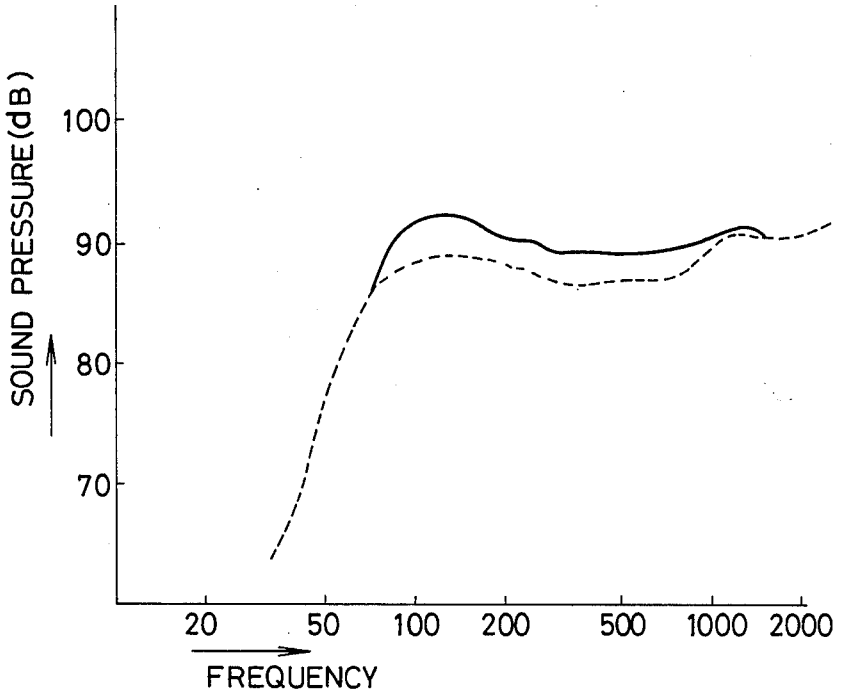
FIG. 3 is a graph showing sound pressure/frequency characteristics of the speaker unit of the invention and the conventional speaker unit compatible with an A/V device.

In FIG. 2, character S represents the whole of a speaker unit. In order to prevent flux leakage of a magnetic circuit unit 1, a second magnet 5 is disposed under a first magnet 4 and the magnetic circuit unit 1 is enclosed with magnetic shield cover 2 made of such as iron sheet and formed generally in a tubular shape with a bottom.

The second magnet 5 opposite in polarity to the first magnet 4 is disposed on the bottom of the magnetic shield cover 2. A second top plate 20 is placed on the second magnet 5. The first magnet 4 is placed on the second top plate 20 while a first top plate 21 is placed on the first magnet 4. In the midst of these elements, there is disposed a common pole piece 22 whose lower end is provided with a magnetic reluctance area 23 and fixed to a bottom surface 2*a* of the magnetic shield cover 2. In this embodiment, although the magnetic reluctance area 23 is realized by using magnetic reluctance material, it is not intended to be limited thereto. Reference 8 represents a common voice bobbin around which upper first and lower second voice coils 24 and 25 are wound. The first and second voice coils 24 and 25 are disposed facing upper first and lower second gaps 26 and 27, respectively. The first and second magnet 4 and 5 are magnetized to have opposite magnetic poles; for example in this embodiment, S poles of both magnets 4 and 5 face each other. Therefore, the directions of magnetic flux at the first and second gaps 26 and 27 are opposite to each other. In this embodiment the windings of the first and second voice coils 24 and 25 are wound in opposite directions, so that if currents of the same phase flow through the coils 24 and 25, the directions of movement of the coils are of the same phase.

It is noted that the first and second windings 24 and 25 may be wound in the same direction. In this case, by inverting the phases of currents passing through the voice coils 24 and 25, the same directions of movement of the coils are obtained. Frequency control such as suppressing a resonance at $f_0$ can be made easily by using a low-cut filter or the like and inputting particular frequency components to one of the voice coils, e.g., the second voice coil 25. In FIG. 2, references 7, 9, 10 and 11 respectively represent a frame, diaphragm, damper, and dust cap, all of which are similar to those conventional elements.

Next, the principle of operation will be described. First, in case of a same phase drive or a drive with the same directions of vibration of the coils, a signal covering the whole frequency band is applied to the voice coil 24 for example, while a signal having passed a filter and having a particular frequency band is applied oppositely in phase to the voice coil 25. In this case, since the magnetic poles at the gaps 26 and 27 are opposite to each other, the voice coils are driven in the same phase. Thus, over the frequency band the voice coils operate, magnetic energy and the turns of windings of the coils are apparently increased to thereby enhance the drive power. Sound pressure/frequency characteristics with low frequency band enhanced are shown in FIG. 3. As compared with the characteristic curve (broken line)

standing for a single voice coil drive, the characteristic curve (solid line) standing for the present invention shows an increase of sound pressure by 3 to 4 dB. In the above operation, it is preferable to set the distance between the two gaps so as not to interact with each other.

Figure 4A:
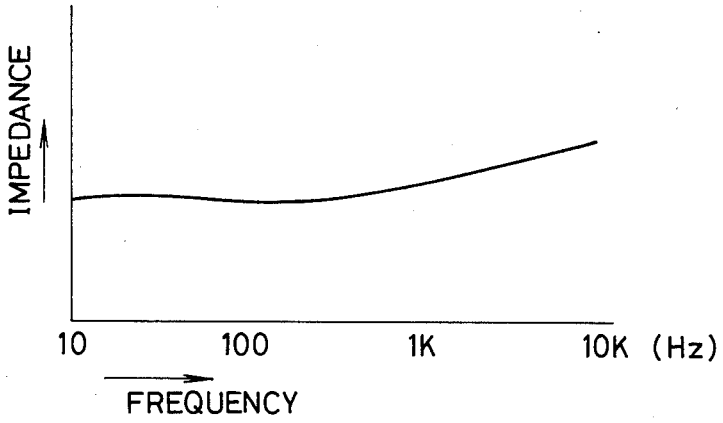
FIGS. 4(A) and 4(B) show graphs of impedance/frequency characteristics of the speaker unit of the invention and the conventional speaker unit compatible with an A/V device.
Figure 4B:
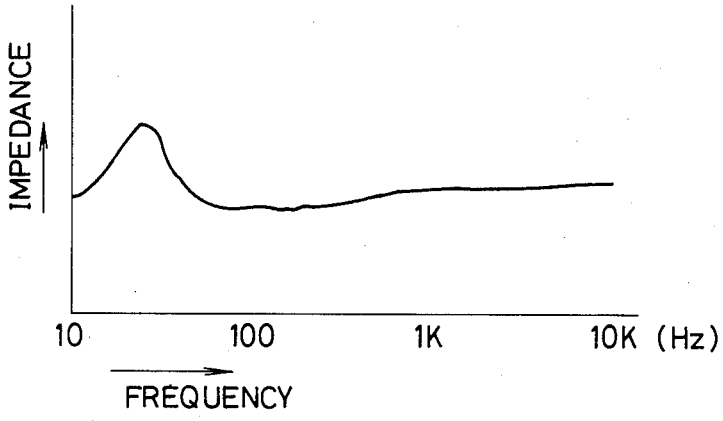

Next, the operation of driving the two voice coils in opposite phase will be described. Damping is effected by supplying signals of the same phase to the voice coils 24 and 25 in such a manner that the coils move oppositely to each other. By doing so, a peak at $f_0$ of the impedance characteristic of FIG. 4(B) can be suppressed as shown in FIG. 4(A). In this case, the damping factor, i.e., a proportion of suppressing the peak at f may be varied as desired by changing the difference between magnetic flux densities of the two gaps or the turns of the coils. Also in this case, it is preferable to set the distance between the two gaps so as not to interact with each other.

A description will be given for the case that the two gaps are disposed adjacent to each other and signals of a large amplitude are applied to the coils. Assuming that signals are applied such that the voice coil bobbin 8 advances, the first voice coil 24 moves apart from the first gap 26 to suppress the advancing force, whereas the second voice coil 25 comes near the first gap 26 so that the repulsion force thereof suppresses similarly the advancing force of the second voice coil 25.

Alternatively, assuming that signals are applied such that the voice coil bobbin 8 withdraws, the second voice coil 25 moves apart from the second gap 27, whereas the first voice coil 24 comes near the second gap 27, thereby decreasing the withdrawal force.

In the above operation, the damping factor acting upon the voice coil bobbin 8 increases proportionally as the input signals become large. Therefore, a faithful operation is attained with a large input being suppressed properly. In the above operation, it is desirable to make the distance l between the first and second gaps 25 and 27 sufficiently short. The adjustment of the distance l enables a setting of the damping factor as desired, which is a kind of loudness effect.

As seen from the foregoing, the speaker unit of this invention has an advantageous effect in magnetic shielding. Furthermore, since magnetic energy of a magnet for magnetic shielding mounted heretofore only for the purpose of preventing magnetic leakage, is utilized as energy for driving a voice coil, the efficiency in operation can be improved remarkedly.

In the above embodiment, two voice coils have been mounted at the two gaps having opposite directions of magnetic flux, so that the impedance or low frequency characteristic can be improved. Furthermore, if a signal of a particular frequency band is applied to one of the two coils, any frequency characteristic as desired can be obtained and it is effective in enhancing a low frequency band. Also, since a conventional magnet for magnetic shielding is used, there is little increase in cost. The speaker unit of this invention is particularly advantageous for use as a speaker compatible with an audio/-visual device.

I claim:

1. A speaker system comprising:

(a) a magnetic circuit including a pole piece, a first magnetic member facing with the pole piece to define a first air gap, a second magnetic member facing with the pole piece to define a second air gap which is spacially separated from the first air gap, a first magnet disposed between the first and second magnetic members to provide magnetic flux at said first air gap and to contribute to the magnetic flux at said second air gap, and a second magnet disposed under the second magnetic member, the second magnet being magnetized in an opposite polarity to the first magnet to provide magnetic shielding and to contribute to the magnetic flux at said second air gap;

(b) a speaker diaphragm connected to a voice coil bobbin on which first and second voice coils are wound, the first and second voice coils being arranged to be respectively placed in the first and second air gaps;

(c) a driver for producing first and second drive signals respectively applied to the first and second voice coils.

2. A speaker system according to claim 1 further comprising:

(d) a cover of magnetic material for covering said magnetic circuit, to complete the magnetic shielding of said magnetic circuit.

3. A speaker system according to claim 2 further comprising:

(e) a magnetic reluctance formed between said pole piece and said cover.

4. A speaker system according to claim 1, wherein the frequency characteristics of the second drive signal are different from that of the first drive signal.

5. A speaker system according to claim 1, wherein the first and second voice coils are driven in opposite phases to each other by the first and second drive signals to suppress the peak of impedance at a low resonant frequency (fo).

6. A speaker system according to claim 1, wherein the respective space distances in the region of the first and second air gaps are each magnetically closed such that extreme movements of the first and second voice coils would respectively be suppressed by the magnetic fields of the second and first air gaps.

7. A speaker system comprising:

a first magnetic member facing with the pole piece to define a first air gap, a second magnetic member facing with the pole piece to define a second air gap which is spacially separated from the first air gap, a first magnet disposed between the first and second magnetic members to provide magnetic flux at said first air gap and to contribute to the magnetic flux at said second air gap, and a second magnet disposed under the second magnetic member, the second magnet being magnetized in an opposite polarity to the first magnet to provide magnetic shielding and to contribute to the magnetic flux at said second air gap;

the magnetic fields in the first and second air gaps being opposite in polarity;

a diaphragm connected to a voice coil bobbin on which first and second voice coils are wound in spacially separate parts, the first and second voice coils being arranged to be respectively placed in the first and second air gaps; and a driver for producing first and second drive signals respectively applied to the first and second voice coils, wherein the frequency characteristics of the second drive signal are different from that of the first drive signal.

8. A speaker system comprising:

a first magnetic member facing with the hole piece to define a first air gap, a second magnetic member facing with the pole piece to define a second air gap which is spacially separated from the first air gap, a first magnet disposed between the first and second magnetic members to provide magnetic flux at said first air gap and to contribute to the magnetic flux at said second air gap, and a second magnet disposed under the second magnetic member, the second magnet being magnetized in an opposite polarity to the first magnet to provide magnetic shielding and to contribute to the magnetic flux at said second air gap;

the magnetic fields in the first and second air gaps being opposite in polarity;

a diaphragm connected to a voice coil bobbin on which first and second voice coils are wound in spacially separate parts, the first and second voice coils being arranged to be respectively placed in the first and second air gaps; and a driver for producing first and second drive signals respectively applied to the first and second voice coils, wherein the first and second voice coils are driven in opposite phases to each other by the first and second drive signals to suppress the peak of impedance at a low resonant frequency (fo).

9. A speaker system comprising:

a magnetic circuit including first and second air gaps, the magnetic fields in the first and second air gaps being opposite in polarity;

a diaphragm including a voice coils bobbin on which first and second voice coils are wound in spacially separate parts, the first and second coils being arranged to be respectively placed in the first and second air gaps; and a driver for producing first and second drive signals respectively applied to the first and second voice coils, wherein the respective space distances in the region of the first and second air gaps are each magnetically closed such that extreme movements of the first and second voice coils would respectively be suppressed by the magnetic fields of the second and first air gaps.

* * * * *